US005263769A

United States Patent [19]

Pharr et al.

[11] Patent Number: 5,263,769

[45] Date of Patent: Nov. 23, 1993

[54] APPARATUS FOR PLANING A PAVED SURFACE

[76] Inventors: John P. Pharr, Rte. 13; Ridge Rd., Canton, Ga. 30114; Cynthia L. Decker; David S. Decker, both of 343 Ammons Rd., Waleska, Ga. 30183

[21] Appl. No.: 831,799

[22] Filed: Feb. 5, 1992

[51] Int. Cl.[5] ..... E01C 23/08; E01C 23/12; E21C 25/00

[52] U.S. Cl. ..... 299/39; 299/89; 299/90; 404/91; 51/176

[58] Field of Search ..... 299/39, 34, 36, 79, 299/89, 91; 404/90, 91; 51/176; 125/5, 9

[56] References Cited

U.S. PATENT DOCUMENTS

| | | | |
|---|---|---|---|
| 2,277,236 | 3/1942 | Kneisley et al. | 51/176 |
| 3,156,231 | 11/1964 | Harding, Jr. | 299/39 |
| 3,989,304 | 11/1976 | Wirtgen | 299/39 |
| 4,310,198 | 1/1982 | Destree | 299/39 |
| 4,838,729 | 6/1989 | Chennels | 299/89 X |
| 4,878,713 | 11/1989 | Zanetis | 299/39 |
| 4,953,523 | 9/1990 | Swan | 299/39 X |

*Primary Examiner*—Stephen J. Novosad

*Attorney, Agent, or Firm*—Michael V. Drew

[57] ABSTRACT

A planer assembly is mounted upon a main frame. The planer assembly has a set of blades installed upon a rotable drum. The blades have tips containing deposits of material which abrades hardened pavement. The planer assembly is mounted upon the main frame in a manner that allows the weight of the frame and other components to bear down upon the blade assembly. As the drum rotates, the blades grind paving material from the paved surface. The depth of grinding, or planing, is controlled by the distance between the blade assembly and the surface to be planed. The distance between the blade assembly and the surface to be planed is determined by the distance that is maintained between the frame and the surface to be planed. The distance between the frame and the surface to be planed is adjusted by turning a stationary threaded rod which engages a threaded block mounted upon the axle frame of wheels of the main frame. The axle frame is pivotally mounted to the main frame. Turning of the threaded rod moves the threaded block along the length of the rod causing the axle frame to change its angular relationship with respect to the frame.

5 Claims, 5 Drawing Sheets

APPARATUS FOR PLANING A PAVED SURFACE

TECHNICAL FIELD OF THE INVENTION present invention relates to an apparatus and method for removing paving material from a paved surface, and more particularly to an apparatus and method for removing paved material from a paved surface by planing the paved surface.

BACKGROUND OF THE INVENTION

It is often necessary to remove paving material, such as concrete of asphalt, from a paved surface. For example, water often will not drain properly from a paved parking lot or roadway and it is necessary to remove paving material from the surface to allow for proper drainage. It is difficult to remove paving material from a finished, paved surface because the material has substantially hardened by the time that it becomes necessary to remove some of the paving material from the surface. The removal of hardened paving material from a paved surface is even more difficult when it is necessary to remove only small depths of paving material, as is the case when paving material needs to be removed to alleviate a drainage problem. Removal of small depths of paving material is a problem because traditional cutting tools such as saws cannot be used. A device must be used which is sturdy enough to remove hardened pavement but which can also be controlled to remove pavement in small quantities.

SUMMARY OF THE INVENTION

It is an object of the invention to provide a means for removing paving material from a paved surface.

It is a further object of the invention to provide a means for removing paving material from a paved surface in small increments of depth.

In the present invention, a planer assembly is mounted upon a main frame. The planer assembly has a set of blades installed upon a rotatable drum. The blades have tips, or leading edges, containing deposits of material which abrades hardened pavement. The planer assembly is mounted upon the main frame in a manner that allows the weight of the frame and other components to bear down upon the blade assembly. As the drum rotates, the blades grind paving material from the paved surface. The depth of grinding, or planing, is controlled by the distance between the blade assembly and the surface to be planed. The distance between the blade assembly and the surface to be plane is determined by the distance that is maintained between the frame and the surface to be planed. The distance between the frame and the surface to be planed is adjusted by turning a stationary threaded rod which engages a threaded block mounted upon the axle frame of wheels of the main frame. The axle frame is pivotally mounted to the main frame. Turning of the threaded rod moves the threaded block along the length of the rod causing the axle frame to change its angular relationship with respect to the frame. The main frame is at its greatest distance from the ground when the axle frame is essentially perpendicular to the main frame. The main frame, and planer assembly, are lowered as the axle frame moves through angular alignments less than ninety degrees.

Other aspects, objects, features, and advantages of the present invention will become apparent to those skilled in the art upon reading the detailed description of preferred embodiments.

BRIEF DESCRIPTION OF THE DRAWINGS

FIG. 3 is an exploded isometric illustration of the planer assembly of. FIG. 2 without the planer assembly support blocks.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described with reference to the following description of embodiments taken in conjunction with the accompanying drawings.

Figure 1:
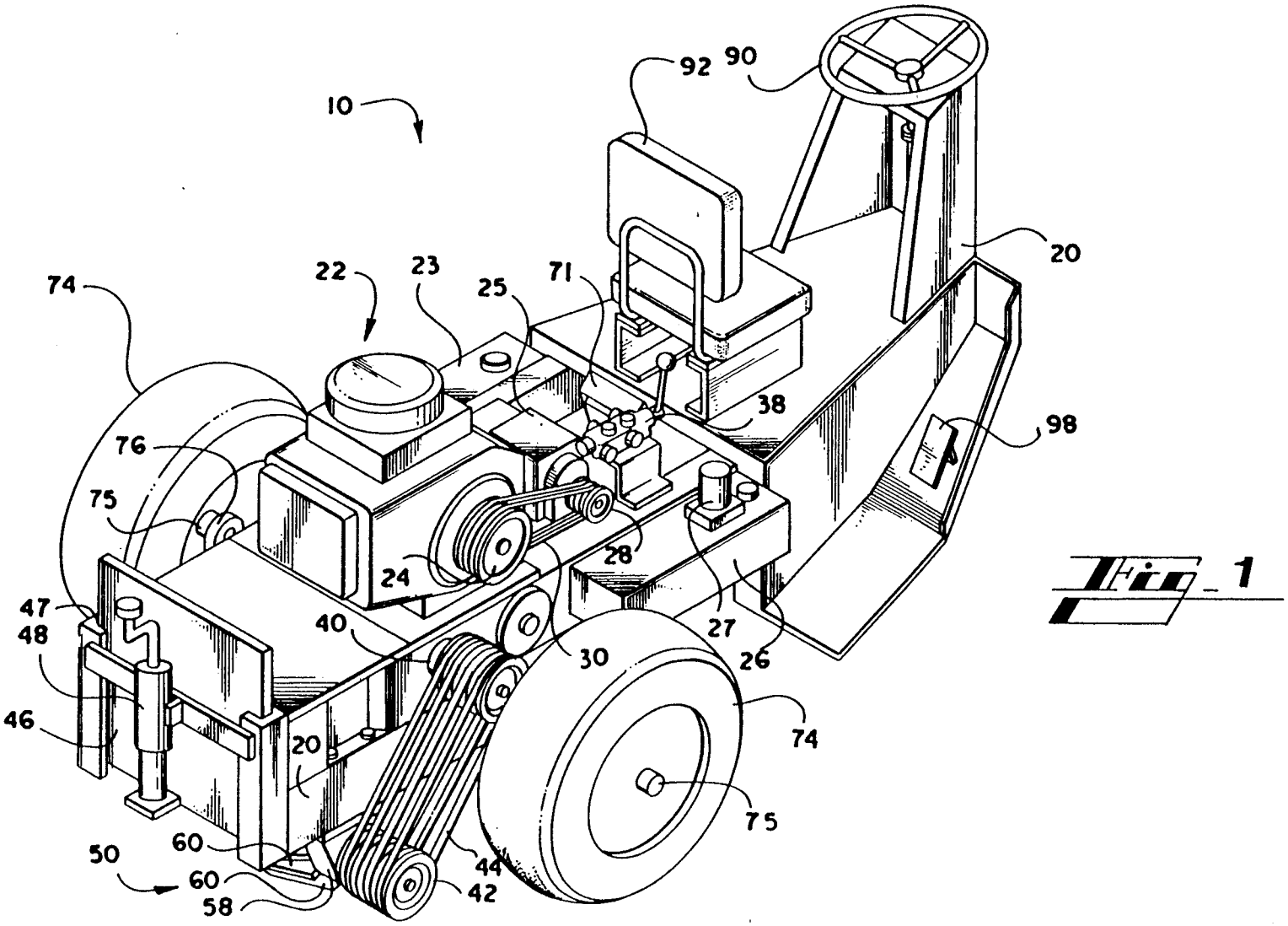
FIG. 1 is an isometric illustration of an apparatus for planning a paved surface according to a preferred embodiment of the invention.

In a preferred embodiment of the invention a planer assembly and a height adjustment assembly are combined with a propellable main frame to form the key components of an apparatus for planing a paved surface. Referring first to FIG. 1, therein is shown an apparatus for planing a paved surface 10 according to a preferred embodiment of the present invention. The apparatus 10 is shown looking from the rear portion toward the front portion of its main frame 20. The power plant for this embodiment is an engine 22. A fuel tank 23 for the engine 22 is attached to a side of the main frame 20. A series of pulleys 24 transmits power from the engine 22. The power output of the engine 22 is transmitted to a hydraulic pump 25 by a series of belts 30 which connect the series of pulleys 24 of the engine 22 to the series of pulleys 28 connected to the pump 25. A fluid tank 26 and filter 27 for the hydraulic pump are attached to a side of the main frame 20. The hydraulic pump 25 drives the three power components of the apparatus 10, namely, a planer assembly 50 which does the planing, a height adjustment assembly 70 (not shown in this view) which determines the depth of planing, and a drive wheel 94 (not shown in this view) which propels the apparatus 10. Although these three power components could be driven by any suitable fluidized or direct engine coupling mechanisms, a hydraulic system provides the necessary power which can be easily dispensed at different points along the frame at a reasonable cost and efficiency. The three power components will be discussed in greater detail below. A controller 38 for the height adjustment motor 71 is positioned close to the seat 92 of the apparatus for easy access by an operator.

The height adjustment assembly will be explained in detail below, but, in general, it raises and lowers the main fame 20 with respect to the rear wheels 74. The rear wheels 74 are connect=d to the main frame 20 by through axles 75 connected to axle frames 76 which are in turn connected to the main frame 20. In the preferred embodiment of the apparatus 10 shown, the planer assembly 50 is mounted beneath the main frame 20 near the extreme rearward portion of the main frame 20. In FIG. 1 there can be seen several of the blades 60 of the planer assembly 50 as well a one of the mounting blocks 58 which attaches the blade assembly to the frame 20. A shield 47 to minimize the dispersal of debris from the planing process is located at the extreme rear of the apparatus 10. The shield 46 is slidable in a slot 47 formed by the rear of the main frame 20. A crank 48 moves the shield downward or upward so that it is closer to or father away from the ground or surface which is being planed. When the shield is closer to the ground or surface, debris is less likely to exit the rear of the apparatus 10. At the opposite end of the apparatus 10, a steering wheel 90 for guiding the apparatus 10 is positioned at the frontmost portion of the main frame 20. A foot controller 98 for the hydraulic motor 96 of the drive wheel 94 (not shown) is positioned so that it may be engaged by an operator while sitting in the seat 92 and manipulating the steering wheel 90.

Figure 2:
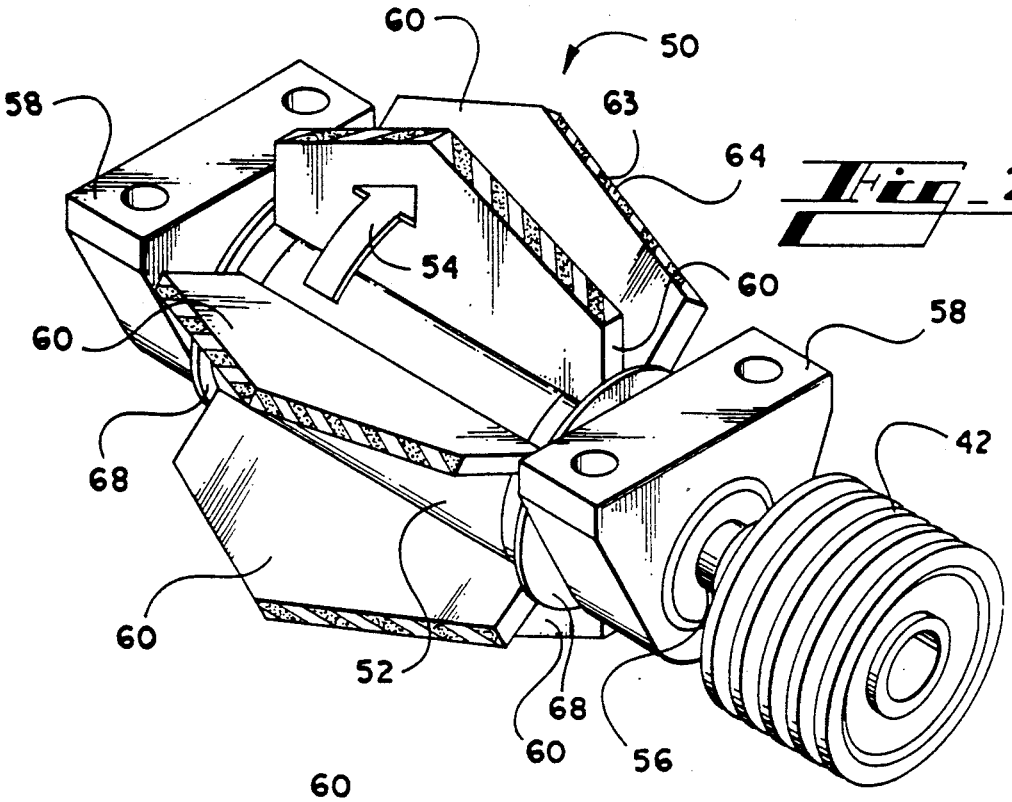
FIG. 2 is an isometric illustration of the planer assembly of the invention of FIG. 1.
Figure 4:
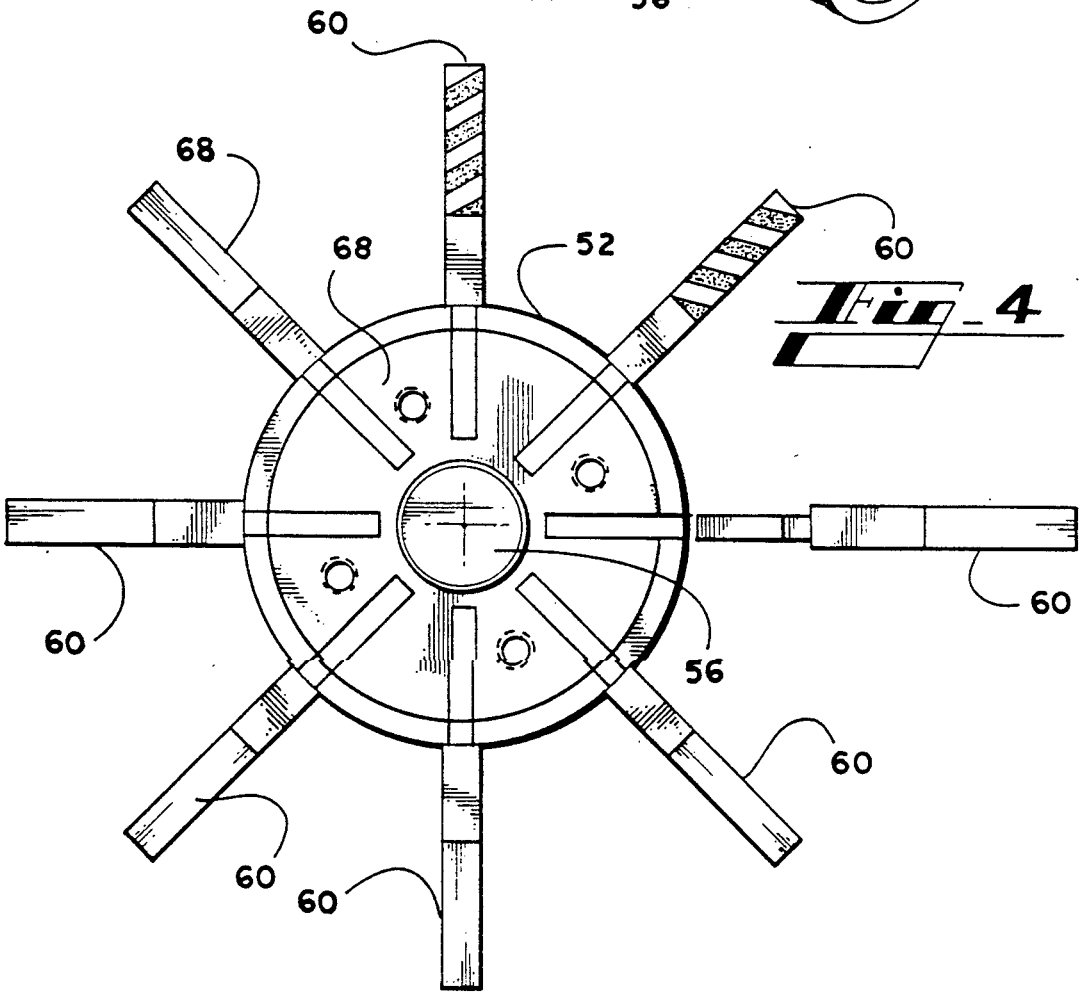
FIG. 4 is a side view of the planer assembly of FIG. 2.
Figure 3:
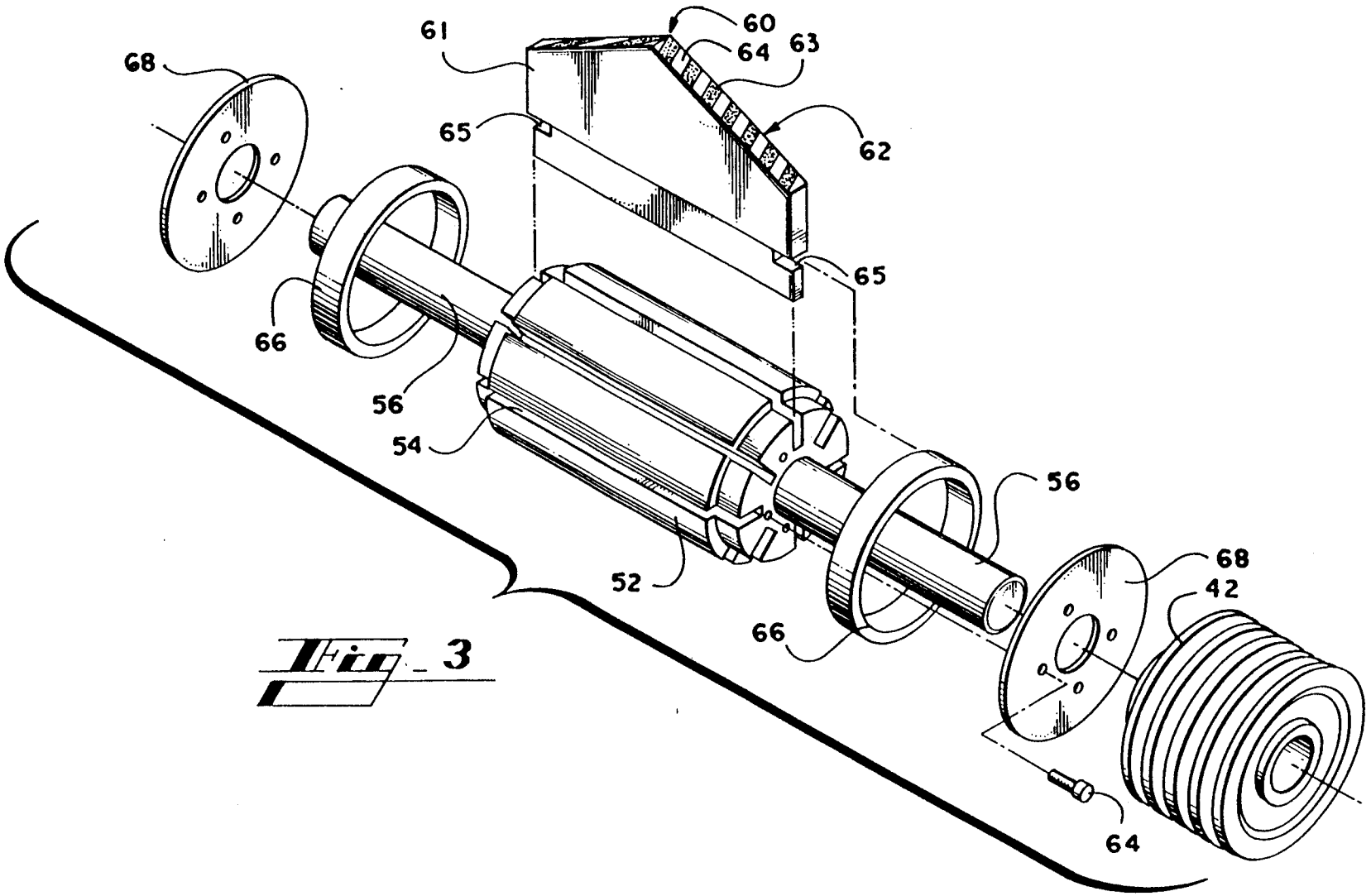

Referring now generally to FIGS. 2, 3, and 4, and to FIG. 2 in particular initially, the planer assembly 50 will be discussed. The apparatus 10 planes pavement by grinding, or scraping, paving material from a paved surface with the blades 60 of the planing assembly 50. The central component of the planer assembly 50 is a drum 52 to which blades 60 are attached. As the drum 52 rotates in the direction shown by the arrow 53 the blades 60 contact and scrape pavement. The planer assembly is attached to the bottom of the frame 20 by support blocks 58 at either end of the drum 52. As previously mentioned, the series of pulleys 42 transmits the power to the planer assembly 50 that rotates the drum 52. Referring now more particularly to FIG. 3, the exploded view shows the interconnection and cooperation of the components of the planer assembly 50. The drum 52 has slots 54 for receiving the blades 60. In this embodiment the ends of the drum 52 are tapered to accommodate other hardware for retaining the blades 60. A shaft 56 extends from either end of the drum 52. Each end of the shaft 56 is held by and rotates within a support block 58 which is shown in FIG. 2. Each blade 60 of the assembly 50 is a plate which has a body 61 with a leading edge 62. The leading edge, or tip, 62 of each blade 60 contains abrading material. The abrading material is a substance which is harder than the pavement which is planed and is what actually contacts the pavement. In general, materials which are harder than pavement can be used, however, to properly apply abrading material in a manner that adheres well to the blade 60, diamond or carbide is suitably applied to the blades 60. The abrading material is deposited in diagonal strips 63 at spaced intervals 64 along the leading edge 62 of the blade 60. Strips of abrading material 63 are applied diagonally to reduce the amount of stress which the abrading material encounters when pavement is contacted. To promote an even cut while still alleviating stress upon the blades 60, the alternating strips of abrading material 63 and spaced intervals 64 are staggered from one blade 60 to another. The staggered alignment can be seen in FIGS. 2 and 4. The preferred embodiment illustrated shows a set of eight blades 60 although other numbers of blades 60 may also be used. Referring again more particularly to FIG. 3, the bottom portion of the body 61 of each blade 60 fits into one of the slots 54 of the drum 52. Each blade 60 also has a notch 65 made in each side to accommodate a locking mechanism. One component of the locking mechanism is a ring 66 which fits over the end of the drum 52 and slips into each notch 65. Another component of the locking mechanism is a disk 68 that fits over the ring 66 and secures it to the drum 52. The disk 68 is attached to the drum 52 by bolts 69. The bolts 69 are the key elements that hold the planer assembly 50 together. The assembly 50 may be quickly and easily disassembled for changing blades as necessary by removing the bolts 69, disks 68 and rings 66. The assembly 50 is reassembled by inserting blades 60 in the slots 54, inserting the rings 66 into the notches 65 over the ends of the drums 52 and then securing the disks over the rings 66. Although the blades 60 may have many different configurations, the leading edge 62 of each blade has an inverted, shallow V-shape which forms an apex. The V-shape produces a pointed cutting tool which is efficient for cutting into surfaces The shallow V-shape also produces a shallow V-shaped trench which mirrors the blade shape.

Referring momentarily to FIG. 4, an end view further illustrates the positioning of the blades 60 with respect to the drum 52.

Figure 5:
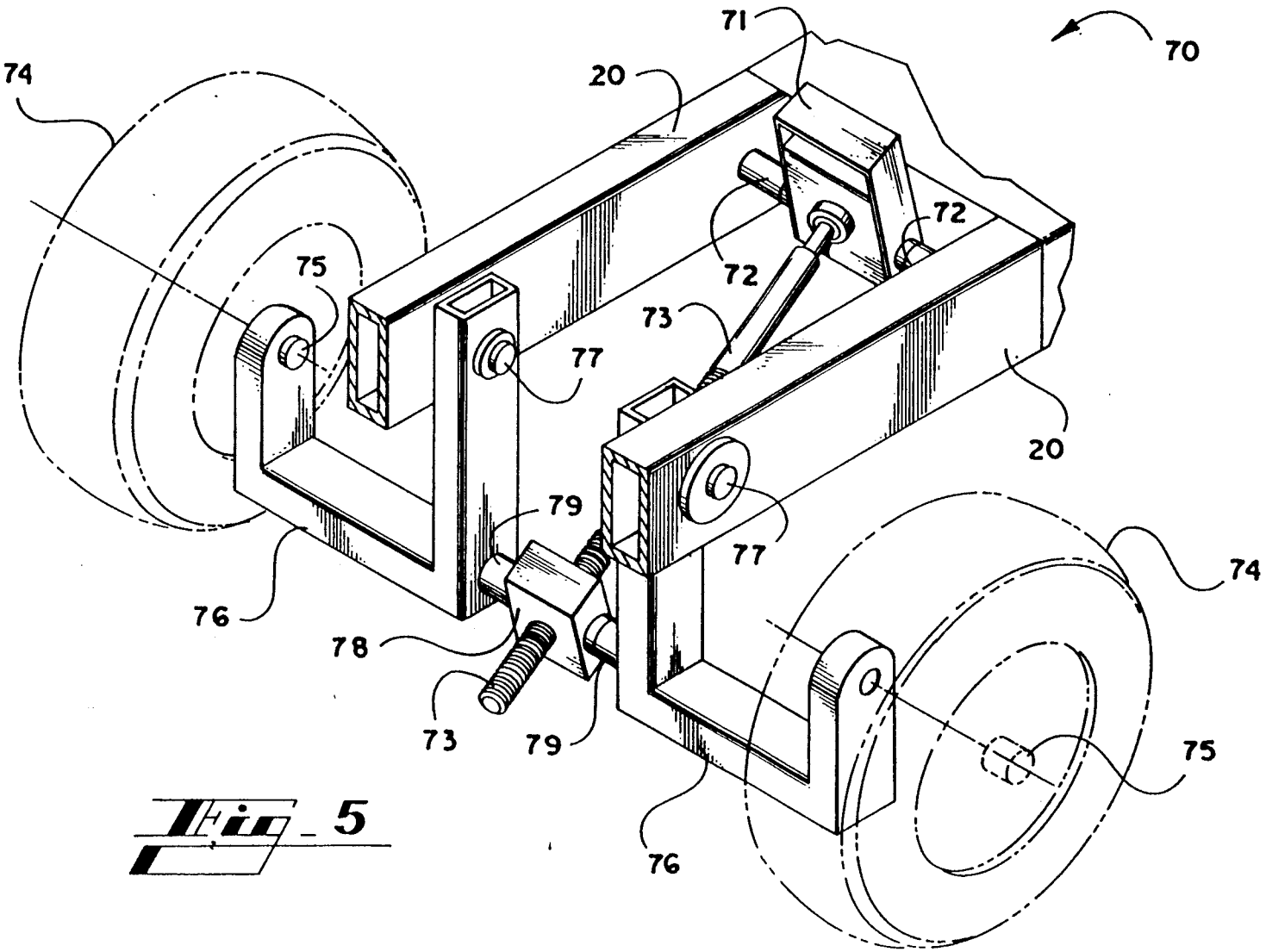
FIG. 5 is an illustration of the height adjustment assembly of the invention of FIG. 1.
Figure 6:
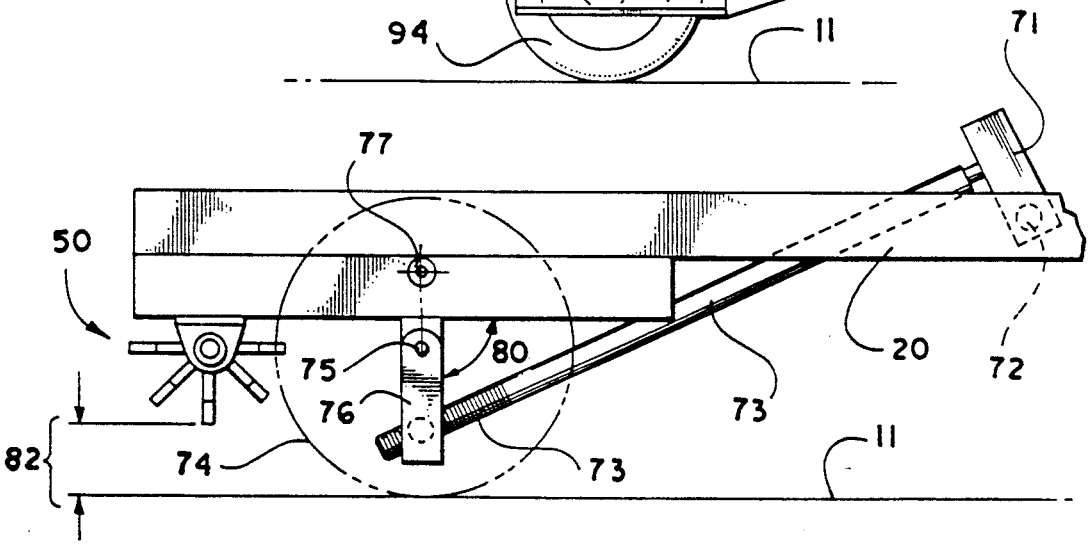
FIG. 6 is a partial side view of the rear end of the invention of FIG. 1 showing the planer assembly and the height adjustment assembly.
Figure 7:
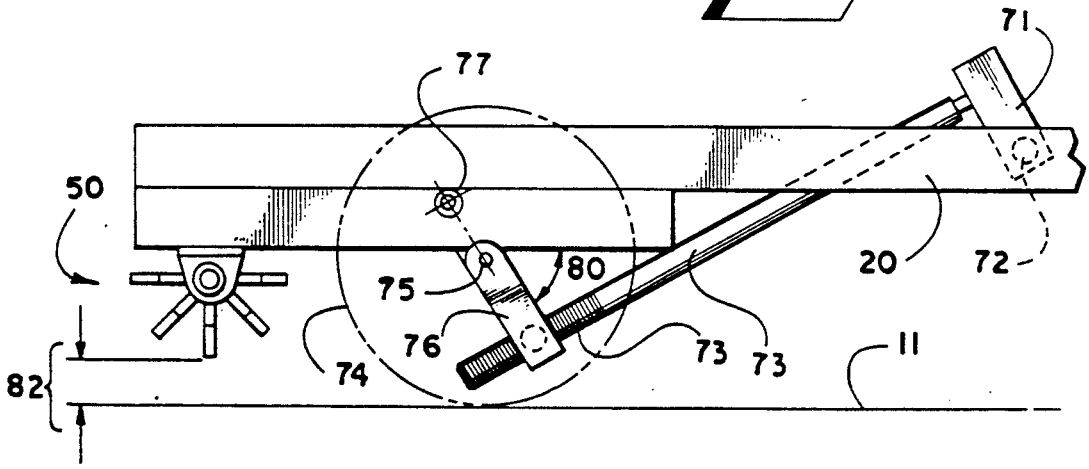
FIG. 7 is a partial side view of the rear end of the invention of FIG. 1 showing the planer assembly and the height adjustment assembly with the axle frame of the height adjustment assembly in a different alignment with respect to the main frame than the alignment shown in FIG. 6.

Referring now to FIG. 5, therein is illustrated the height adjustment mechanism 70 for the apparatus 10. The height of the apparatus 10 with respect to the ground or a surface is the distance between a point on the main frame 20, such as the bottom of the main frame 20 where the planer assembly is attached, and a point on the ground or surface to be planed. The height and distance described immediately above determines the depth to which the blades 60 extend into the ground or surface to be planed. The distance between the main frame 20 in general and the ground is adjusted by changing the angular relationship between the main frame 20 and the axle frames 76. When the axle frames 76 are perpendicular to the main frame 20 the main frame 20 is at its maximum height with respect to the ground or surface. Wheels 74 support the rear of the apparatus 10. The wheels 74 are connected to the main frame 20 through axles 75 which are connected to axle frames 76 which in turn are connected through pivot rods 77 to the main frame 20. The mechanism for changing the angular relationship between the main frame 20 and the axles 76 is a hydraulic motor 71 pivotally mounted to the main frame 20 by pivot rods 72. The motor 71 turns a threaded rod 73 clockwise or counterclockwise. The threads of the threaded rod 73 engage a threaded block 78 which is pivotally connected to the axle frames 76 by pivot rods 78. Referring now also to FIGS. 6 and 7, the angular relationship between the main frame 20 and the axle frames 76 is more clearly illustrated. When the threaded rod 73 is turned in a direction that moves the threaded block 78 toward the motor 71, the angle 80 between the main frame 20 and axle frame 76 is reduced causing the distance 82 between the blades 60 of the rotating assembly 50 and the paved surface 11 to decrease. Reversing the direction of rotation of the threaded rod 73 increases the distance 80.

Figure 8:
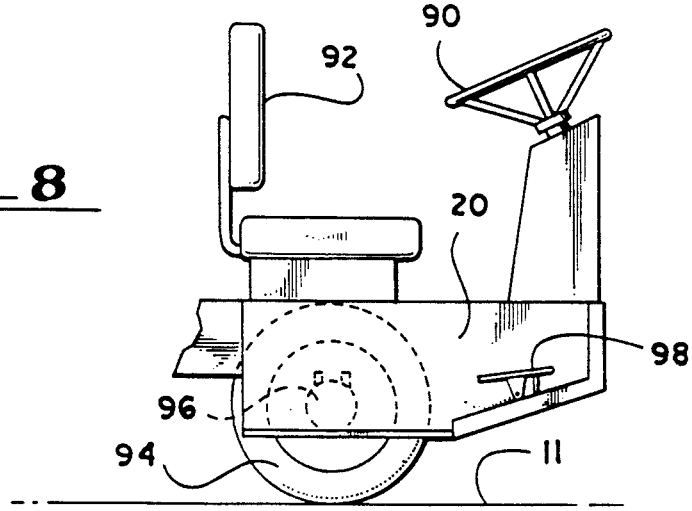
FIG. 8 is a partial side view of the front end of the invention of FIG. 1.

Referring now to FIG. 8, the positioning of components in the operational area of the apparatus 10 is illustrated. The seat 92 is positioned so that an operator has convenient access to the steering wheel 90, which turns the drive wheel 94. The drive wheel 94 is powered by a hydraulic motor 96. The controller 98 for the motor 96 of the drive wheel 94 is conveniently located as a foot pedal actuator that may be incrementally pressed on the forward end to activate fluid flow through the motor 96 that moves and accelerates the apparatus 10 in a forward direction. The foot controller 98 may be incrementally depressed on the rear portion of the pedal to activate fluid flow through the motor 96 that moves and accelerates the apparatus rearward.

The apparatus 10 is operated by driving over a surface to be planed and lowering the height of the main frame 20 until the blades 60 of the planer assembly 50 scrape away a desired amount of pavement. To extend the life of the blades 60 and facilitate planing, water is passed over the surface which is planed.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. An apparatus for planing a paved surface comprising:

a frame having a front and a rear;

at least one first wheel mounted proximate said front of said frame having means for propelling and steering said wheel;

a pair of second wheels pivotally connected on either side of said frame intermediate said at least one first wheel and said rear of said frame for supporting said frame a distance above the paved surface;

means for selectively altering said distance which said frame is supported above the paved surface;

a rotatable planing assembly having a plurality of blades, each said blade having a body having a leading edge and a rear edge, and defining a notch at each of two sides proximate said rear edge thereof, a drum defining a plurality of slots for respectively receiving said plurality of blades, a shaft extending from either end of said drum, an annular member adapted for fitting over either end of said drum and engaging said notch defined in each said blade, an annular plate adapted for engaging said annular member, means for removably securing said annular plate to said drum, and means removably mountable proximate said rear of said frame for rotatably receiving said shaft extending from either end of said drum;

means for rotating said drum of said rotatable planing assembly; and a plate slidably affixed at said rear of said frame.

2. The invention of claim 1, said means for propelling said at least one first wheel comprising hydraulic means.

3. The invention of claim 1, wherein said pair of second wheels pivotally connected on either side of said frame intermediate said at least one first wheel and said rear of said frame are connected through a corresponding pair of U-shaped members, each said U-shaped member having a first end and a second end, said first ends of said U-shaped members pivotally connected on either side of said frame intermediate said at least one first wheel and said rear of said frame, each said second wheel pivotally connected to said second end of said U-shaped member; and wherein said means for selectively altering said distance which said frame is supported above the paved surface comprises a threaded block pivotally connected between said U-shaped members, a threaded member having a first end for receiving a rotational force and having a second end having threads corresponding to and to be received by threads of said threaded block, a hydraulic motor means connected to said first end of said threaded member for rotating said threaded member, and means pivotally connecting said hydraulic motor to said frame in relationship to said threaded block so that as said threaded member is rotated said U-shaped members are moved through an arc about an axis through points of connection of said first ends of said U-shaped members.

4. An apparatus for planing a paved surface comprising:

a frame having a front and a rear;

a hydraulic pump;

power means for driving said hydraulic pump;

at least one wheel for propelling and guiding said frame across the paved surface;

a first hydraulic motor for driving said at least one wheel for propelling and guiding said frame across the paved surface;

means for controlling said first hydraulic motor and for connecting said first hydraulic motor and said hydraulic pump;

means for steering said at least one wheel for propelling and guiding said frame across the paved surface;

pair of U-shaped members each having a first end and a second end, said first ends pivotally connected proximate said rear of said frame on either side of said frame;

a pair of wheels for supporting said frame, one of each said wheels for supporting said frame pivotally connected to said second end of said U-shaped member;

a threaded block pivotally connected between said U-shaped members;

a threaded member having a first end for receiving a rotational force and having a second end having threads corresponding to and to be received by threads of said threaded block;

a second hydraulic motor connected to said first end threaded member for rotating said threaded member;

means pivotally connecting hydraulic motor to said frame in relationship to said threaded block so that as said threaded member is rotated said U-shaped members are moved through an arc about an axis through points of connection of said first ends of said U-shaped members;

means for controlling said second hydraulic motor and for connecting said second hydraulic motor to said hydraulic pump;

a rotatable planing assembly having a drum having an outer surface defining a plurality of longitudinal slots each said slot having a depth, a plurality of blades corresponding to and to be fitted within said longitudinal slots of said drum, each said blade having a pentagonal shape, having an essentially rectangular bottom edge and having a leading edge forming an apex of said pentagonal shape, defining a notch on either side of said blade intermediate said leading edge and said bottom edge, having a distance between said bottom edge and a beginning of said notch equal to said depth of said slots, having a length approximately equal to the length of the drum, each said leading edge having fixedly deposited thereon in transverse diagonal strips at spaced intervals material which abrades hardened paving material, a pair of annular members each having an outer diameter and having an inner diameter slightly larger than a diameter of each end of said drum, and having a distance between said outer diameter and said inner diameter slightly smaller than said notch, a pair of disks each having an outside diameter approximately equal to said outside diameter of each said annular member;

means for securing disks to said drum, and means removably mountable proximate said rear of said frame for rotatably receiving said shaft extending from either end of said drum, wherein said bottom edges of said blades are seated in said slots defined by said drum, said annular members are fitted over said ends of said drum and said disks are secured over said annular members;

a third hydraulic motor for driving said drum of said rotatable planing assembly;

means connecting said third hydraulic motor and said drum of said rotatable planing assembly; and a plate slidably affixed at said rear of said frame.

5. A grinding tool comprising:

a drum having an outer surface defining a plurality of longitudinal slots each said slot having a depth;

a plurality of blades corresponding to and to be fitted within said longitudinal slots of said drum, each said blade having a pentagonal shape, having an essentially rectangular bottom edge and having a leading edge forming an apex of said pentagonal shape, defining a notch on either side of said blade intermediate said leading edge and said bottom edge, having a distance between said bottom edge and a beginning of said notch equal to said depth of said slots, having a length approximately equal to the length of the drum, each said leading edge having fixedly deposited thereon abrading material in transverse diagonal strips at spaced intervals;

a pair of annular members each having an outer diameter and having an inner diameter slightly larger than a diameter of each end of said drum, and having a distance between said outer diameter and said inner diameter slightly smaller than said notch;

a pair of disks each having an outside diameter approximately equal to said outside diameter of each said annular member;

means for securing disks to said drum;

means for rotating said drum; and means for mounting said drum upon a frame so that said drum is rotatable with respect to the frame;

wherein said bottom edges of said blades are seated in said slots defined by said drum, said annular members are fitted over said ends of said drum and said disks are secured over said annular members.

* * * * *